United States Patent [19]

Miyake

[11] Patent Number: 4,906,200

[45] Date of Patent: Mar. 6, 1990

[54] RELAY ADAPTER SOCKET FOR SMALL-SIZE MULTICONTACT PLUG

[75] Inventor: Shuichi Miyake, Mitaka, Japan

[73] Assignee: Moji and Company Limited, Tokyo, Japan

[21] Appl. No.: 317,280

[22] Filed: Feb. 28, 1989

[30] Foreign Application Priority Data

Dec. 23, 1988 [JP] Japan ..... 63-324890

[51] Int. Cl.[4] ..... H01R 13/648

[52] U.S. Cl. ..... 439/101; 439/607

[58] Field of Search ..... 439/101, 105, 222, 607, 439/628, 638, 650, 654, 660, 682

[56] References Cited

U.S. PATENT DOCUMENTS

| | | | |
|---|---|---|---|
| 1,569,869 | 1/1926 | McIntosh | 439/638 X |
| 4,650,270 | 3/1987 | Tajima et al. | 439/607 |
| 4,723,916 | 2/1988 | Fusselman et al. | 439/607 X |

*Primary Examiner*—Eugene F. Desmond

*Attorney, Agent, or Firm*—Browdy and Neimark

[57] ABSTRACT

A relay adapter socket for small-size multicontact plugs is disclosed, which comprises a pair of jack sections symmetrically provided in front and rear portions of a cylindrical body and each including a cylindrical ground terminal, an insulating contact holder surrounded by the ground terminal and a plurality of female contacts insertedly held in female contact accommodation bores of the contact holder, the female contacts of each of the jack sections are connected to corresponding ones of the other. Each pair of corresponding female contacts of the jack sections have their stems united to each other by a uniting member made of a metal sheet forming the pair female contacts so that the pair female contacts and uniting members altogether constitute a crankshaft-like female contact union. A common cylindrical ground terminal is used for the pair jack sections, and it consists of two semi-cylindrical halves fitted on the contact holders such that they are closed edge to edge into a cylindrical form.

2 Claims, 13 Drawing Sheets

RELAY ADAPTER SOCKET FOR SMALL-SIZE MULTICONTACT PLUG

BACKGROUND OF THE INVENTION

1. Field of the Invention

This invention relates to improvements in a relay adapter socket for connecting together small-size multicontact plugs each having a plurality of pin-type contacts.

2. Description of the Prior Art

FIG. 1 shows a three-contact relay adapter socket S for connecting together small-size multicontact plugs P, each of which comprises a cylindrical metal ground terminal 10, an insulating contact holder 11 surrounded by the ground terminal 10 and three pin-type contacts 12 accommodated in the contact holder 11 and serves as a three-contact plug section 1. FIG. 2 shows the detailed construction of the relay adapter socket S. As is shown, the relay adapter socket S comprises a pair of jack sections 3 symmetrically provided in front (i.e., left end in FIG. 2) and rear portions of a cylindrical body 2 and each including a cylindrical ground terminal 30 consisting of metal sheets, an insulating contact holder 31 surrounded by the ground terminal 30 and a plurality of female contacts 33 insertedly held in corresponding female contact accommodation bores 32 of the contact holder 31, the female contacts 33 of each of the jack sections 3 being connected to corresponding female contacts 33 of the other.

The pair of jack sections 3 which are provided in the front and rear portions of the body 2 of the adapter socket S have the same shape for they accommodate the plug sections 1 of the same three-contact small-size multicontact plugs P. However, either jack section 3 is adapted such that it is connected to the plug section 1 of the small-size multicontact plug P on the right side in FIG. 1, i.e., in the second order of relay. Therefore, these jack sections 3 are mounted symmetrically as shown in FIG. 3.

In other words, the jack sections 3 are provided such that the same arrangement pattern of female contacts 33 as before appears when the body 2 is turned 180 degrees about a phantom line w shown in FIG. 2.

Therefore, in the right or rear jack section 3 in FIG. 3 the left side female contact 33-L corresponding to the left side contact pin 12-L of the plug section 1 of the small-size multicontact plug P is found on the left side in plan view, whereas in the left or front jack section 3 like female contact is found on the right side in plan view.

For this reason, when connecting the female contacts 33 of the front and rear jack sections 3 in the body 2 by soldering 35, leads 34 of the central female contacts 33 in the pair jack sections 3 are connected straight, but leads 34 of the left and right side female contacts 33 are connected in a crossed fashion, so that the same contact arrangement pattern as before can be obtained when the front and rear jack sections 3 are turned by 180 degrees. After completion of this connection, the jack sections 3 are assembled in the body 2. Therefore, the assembly is rather cumbersome.

SUMMARY OF THE INVENTION

The present invention has been intended in order to solve the above problem, and its object is to provide novel means for easily performing the operation of connecting the female contacts 33 of the pair jack sections 3 when providing these jack sections 3 face to face in the front and rear portions of the body 2, thus facilitating the assembling of the jack sections 3 in the body 2.

To attain the above object of the invention, there is provided a relay adapter socket for small-size multicontact plugs, which comprises a pair of jack sections symmetrically provided in front and rear portions of a cylindrical body and each including a cylindrical ground terminal consisting of metal sheets, an insulating contact holder surrounded by the ground terminal and a plurality of female contacts inserted and held in corresponding female contact accommodation bores of the contact holder, the female contacts of each of the jack sections being connected to corresponding female contacts of the other jack section, each pair of corresponding female contacts of the pair jack sections having their stems united to each other by a uniting member made of a metal sheet forming the pair female contacts so that the pair female contacts and uniting members altogether constitute a female contact union having a crankshaft plan view, the individual female contacts of the female contact union being insertedly held in associated female contact accommodation bores of the respective sections.

DESCRIPTION OF THE PREFERRED EMBODIMENT

Figure 1:
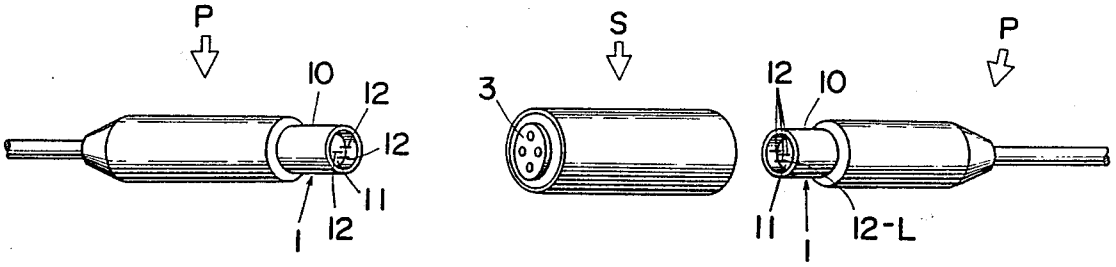
FIG. 1 is a view for explaining a relay adapter socket for small-size multicontact plugs.
Figure 2:
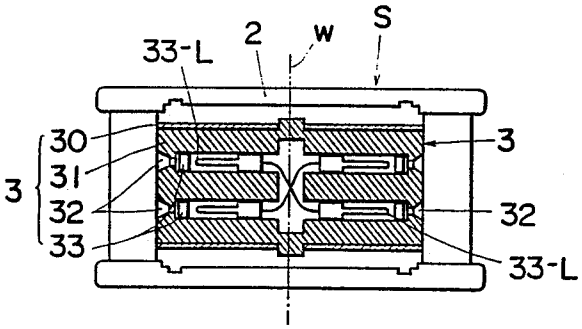
FIG. 2 is an axial sectional view, to an enlarged scale, showing the same adapter socket.
Figure 3:
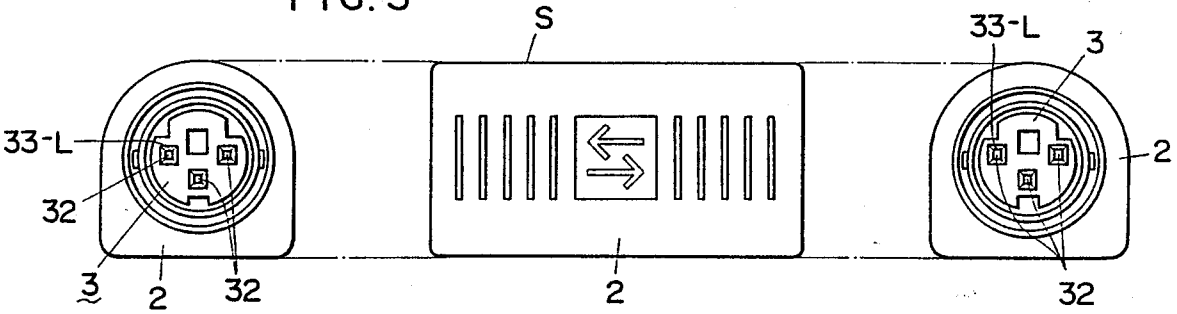
FIG. 3 is an exploded view showing a female contact arrangement pattern of front and rear jack sections of the same adapter socket.
Figure 4:
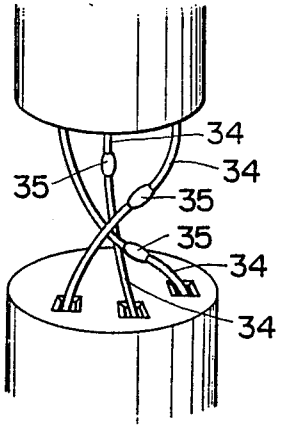
FIG. 4 is a fragmentary pictorial perspective view showing the same adapter socket.

Now, an embodiment of the invention will be described with reference to the drawings. Parts like those noted above in the above description of the prior art are designated by like reference numerals.

Figure 5:
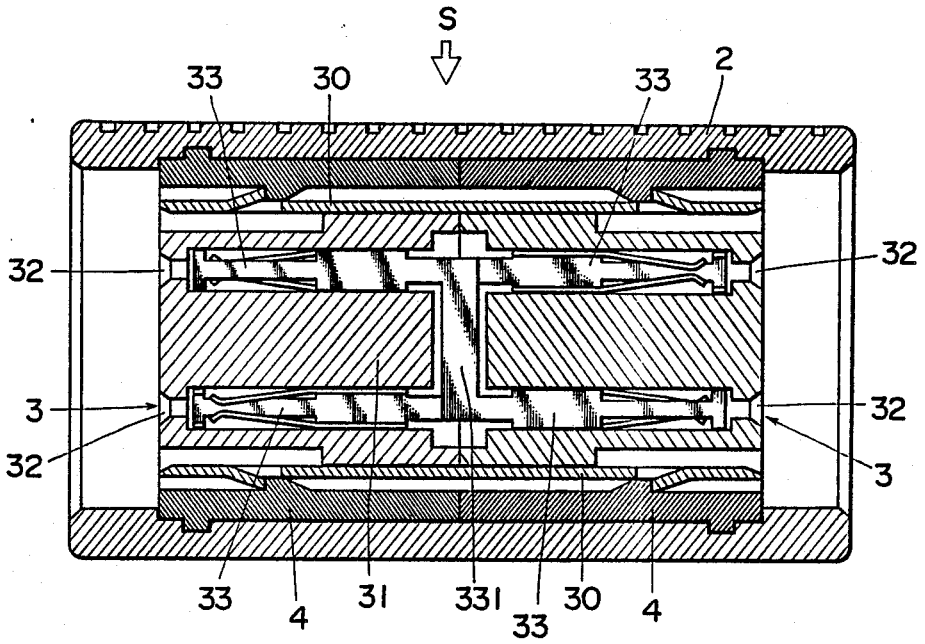
FIG. 5 is an axial sectional view showing an adapter socket according to the present invention.
Figure 8:
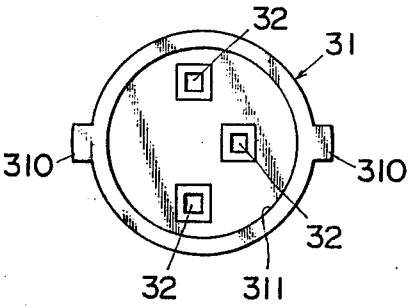
FIG. 8 is a rear view showing the same contact holder.
Figure 6:
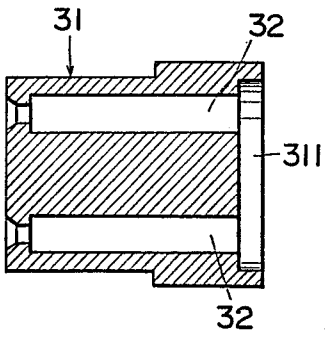
FIG. 6 is an axial sectional view showing a contact holder of the same adapter socket.

FIG. 5 is an axial sectional view showing an adapter socket according to the present invention. Referring to the Figure, reference numeral 2 designates a body, 3 front and rear jack sections assembled in front and rear portions of the body 2, 30 a cylindrical ground terminal of each jack section 3, 31 a contact holder of each jack section 3, 32 female contact accommodation bores formed in each contact holder 31, and 33 female contacts insertedly held in the corresponding accommodation bores 32.

The body 2 is of ordinary type, and it is made of a metal or a synthetic resin and cylindrical in shape. In this embodiment, it is made of a synthetic resin by insert molding on the outer periphery of the jack sections 3 after assembly thereof.

The contact holder 31 of each jack section 3, as shown in FIGS. 6 to 9, although it is the same as the ordinary contact holder so long as it is molded from an insulating synthetic resin such that it has the female contact accommodation bores 32 arranged in a predetermined pattern, has its inner end (i.e., right end in FIG. 6) with upper and lower outward projections 310. In addition, its inner end surface is formed with a recess 311 except for an edge portion. Two such contact holders 31 are used in a back-to-back relation to each other in the respective front and rear jack sections 3.

Figure 10:
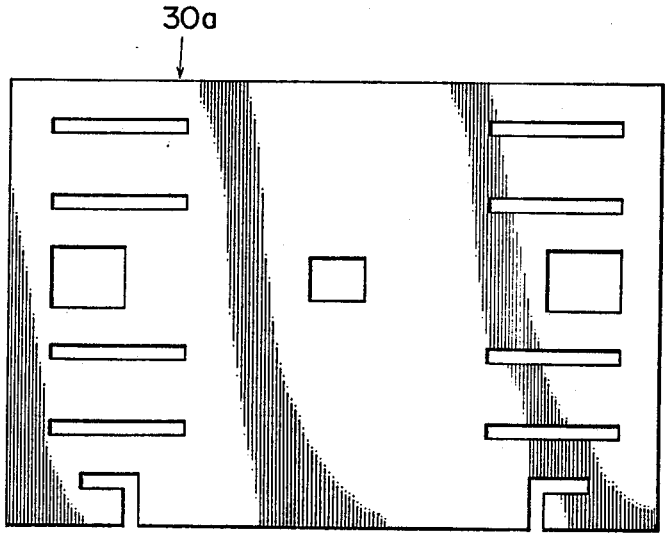
FIG. 10 is a plan view showing a stamped metal sheet constituting an eventual semi-cylindrical half of a cylindrical ground terminal.
Figure 14:
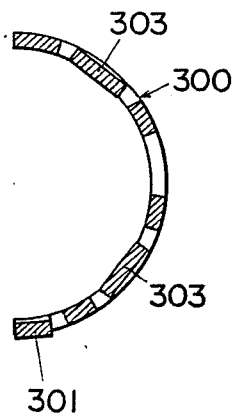
FIG. 14 is a sectional view taken along line A—A in FIG. 11.
Figure 11:
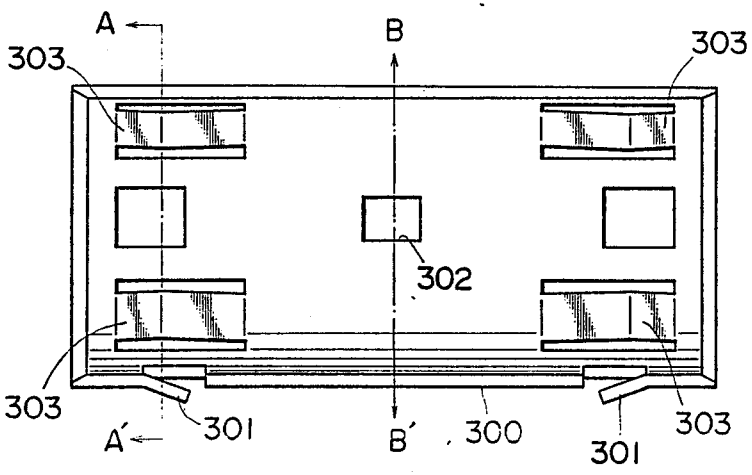
FIG. 11 is a plan view showing the semi-cylindrical half after pre-formation.
Figure 13:
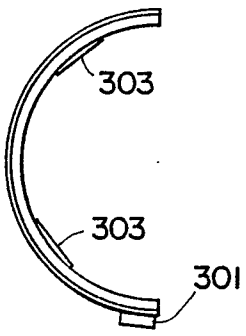
FIG. 13 is a front view showing the same semi-cylindrical half.
Figure 15:
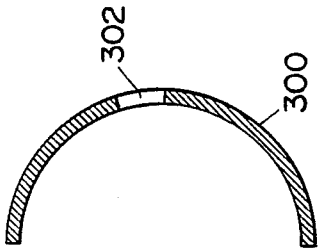
FIG. 15 is a sectional view taken along line B—B in FIG. 11.
Figure 12:
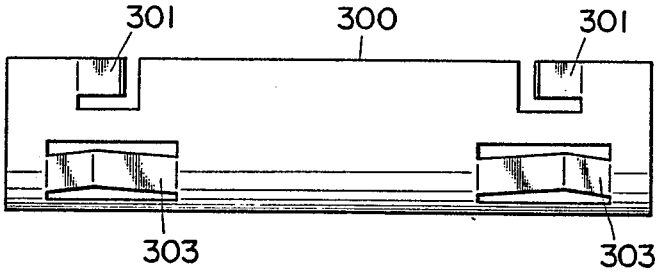
FIG. 12 is a side view showing the same semi-cylindrical half.

The cylindrical ground terminal 30 surrounds these two contact holders 31. It contacts of two semi-cylindrical halves 300 each consisting of a stamped metal sheet 30*a* having a spring character and a predetermined shape as shown in FIG. 10. FIGS. 11 to 15 show the semi-cylindrical half 300. Two such semi-cylindrical halves 300 are assembled into a shell-like or cylindrical form. Each semi-cylindrical half 300 has a pair of locking pawls 301 formed on the left or right (i.e., upper or lower in FIG. 11) edge at positions adjacent to the opposite (i.e., left and right in FIG. 11) ends such that they extend outwardly as one goes toward the longitudinal center of it. It further has an engagement opening 302, which is formed at the center and has substantially double the width of the projections 310. It further has a pair of inward projections 303 formed at positions adjacent to the opposite ends.

Figure 16:
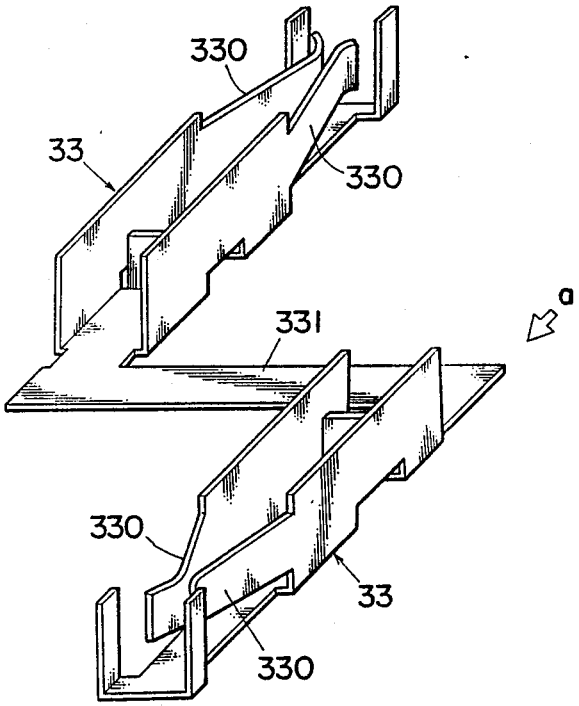
FIG. 16 is a perspective view showing a female contact union.
Figure 17:
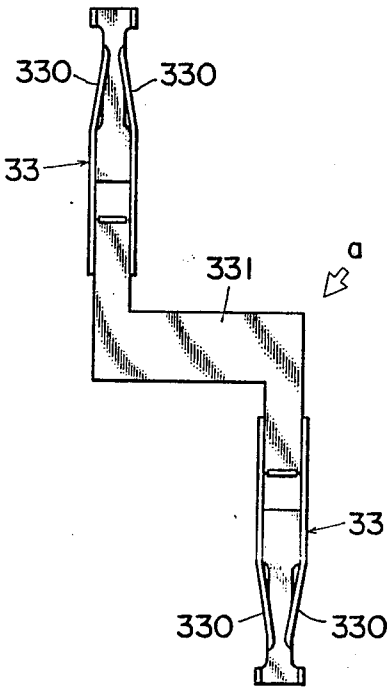
FIG. 17 is a plan view showing the same female contact union.

The female contacts 33 insertedly held in the female contact accommodation bores 32 of the contact holder 31, as in the prior art, each is press formed into a sheath-like form by stamping a metal sheet having a spring character such as to have a pair of contact pieces 330, between which an inserted contact pin 12 is clamped. According to the present invention, however, a pair of corresponding female contacts 33 of the front and rear jack sections 3 are press stamped from a metal sheet integrally with a crankshaft-like shaped uniting member 331, which unites the stems of the pair female contacts 33 in a laterally staggered fashion. As shown in FIGS. 16 and 17, the pair of female contacts 33 in the respective front and rear jack sections 3 are united by the uniting member 331 terminating in the upper and lower ends of the respective female contacts 33 at laterally deviated positions.

Figure 18:
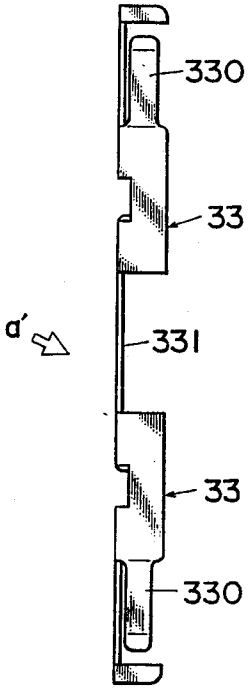
FIG. 18 is a side view showing a different female contact union.
Figure 19:
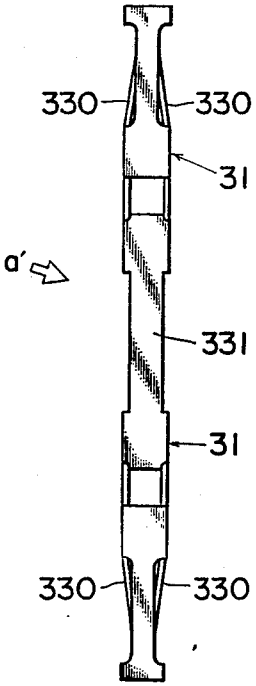
FIG. 19 is a plan view showing the same female contact union.
Figure 22:
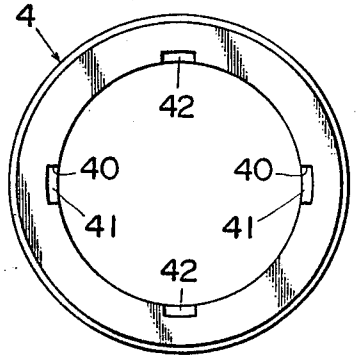
FIG. 22 is a rear view showing the same cylindrical holder.
Figure 20:
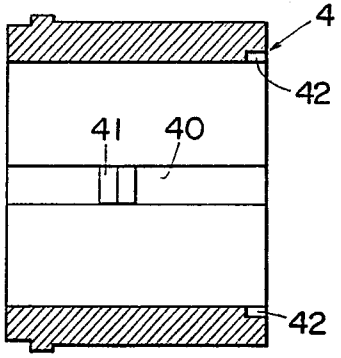
FIG. 20 is an axial sectional view showing a cylindrical holder.
Figure 23:
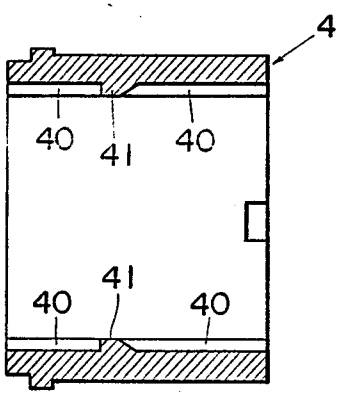
FIG. 23 is an another axial sectional view showing the same cylindrical holder.
Figure 21:
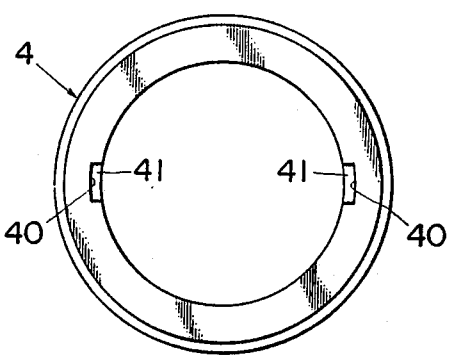
FIG. 21 is a front view showing the same cylindrical holder.

FIGS. 18 and 19 show female contacts 33 which are insertedly held in female contact accommodation bores 32 at the center of the female contact arrangement pattern. In this case, the female contacts 33 of the front and rear jack sections 3 have their stems united by a uniting member 331 along a straight line. In some cases, the uniting member 331 uniting the central female contacts 33 has its longitudinally mid portion located at a mid position between the united female contacts 33.

FIGS. 20 to 23 show a cylindrical holder 4, which is used when assembling the two semi-cylindrical halves 300 into a shell-like or cylindrical ground terminal 30. The cylindrical holder 4 is made of an insulating synthetic resin, and it has an inner diameter corresponding to the outer diameter of the cylindrical ground terminal 30 and a length substantially equal to one half the length of the cylindrical ground terminal 30. It has its inner periphery formed with two diametrically opposed axial guide grooves 40 having a width corresponding to the width of the locking pawls 301 of the semi-cylindrical halves 300 of the cylindrical ground terminal 30. It further has locking protuberances 41 each formed at a longitudinally intermediate portion of each guide groove 40 closer to the outer end (i.e., left end in FIG. 20) than the associated locking pawl 301. Yet further, its inner periphery is formed at the inner end (i.e., right end in FIG. 20) with diametrically opposed recesses 42, in which the projections 310 provided at the inner end of the contact holder 31 is fitted.

Figure 7:
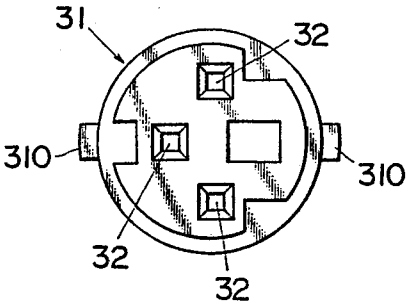
FIG. 7 is a front view showing the same contact holder.
Figure 9:
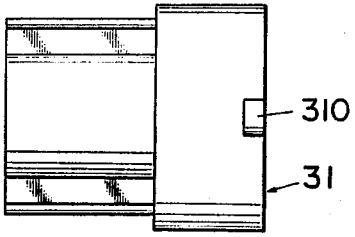
FIG. 9 is a plan view showing the same contact holder.
Figure 24:
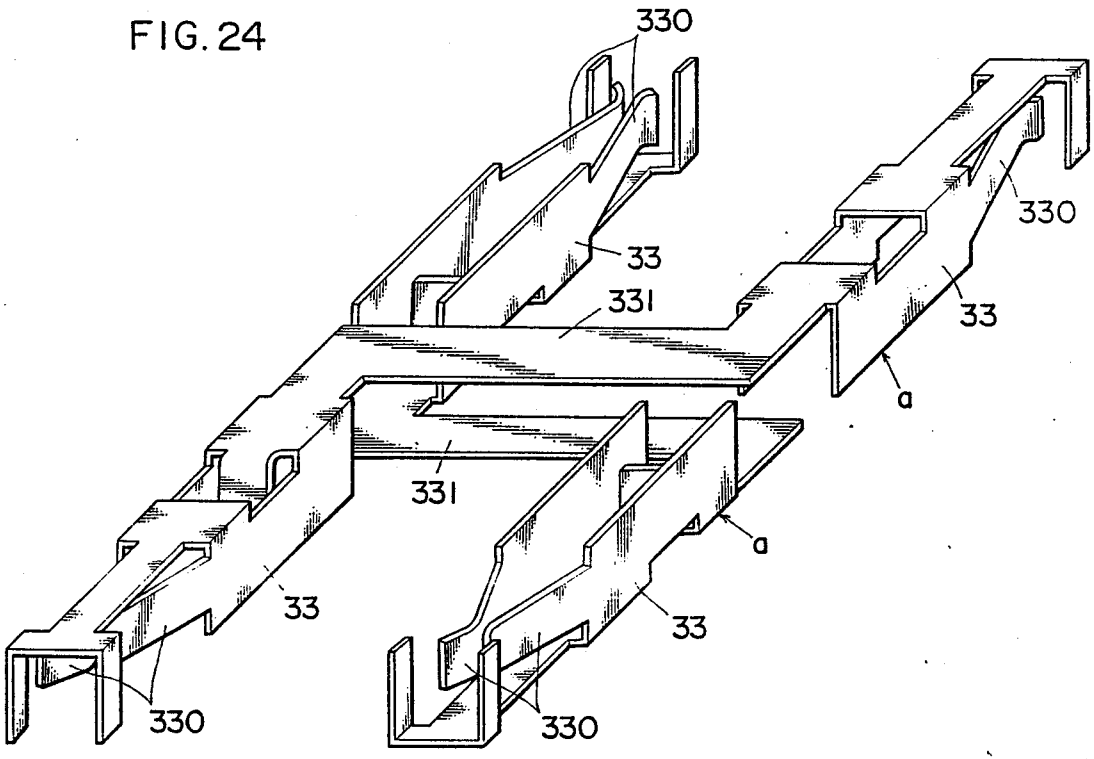
FIG. 24 is a perspective view showing a female contact union combination.

The order of assembling of the adapter socket S comprising the above components will now be described.

Where the adapter socket S to be assembled is for use with two-contact small-size multicontact plugs P, in which the central one of the three female contact accommodation bores 23 of the contact holder shown in FIG. 7 is not used, two female contact unions a are used, each of which, as shown in FIG. 16, has pair female contacts 33 of the respective front and rear jack sections 33 united by the uniting member 331 to be of a crankshaft-like shape. As shown in FIG. 24, these two female contact unions a are set with their uniting members 331 overlapped over one another. In this state, the female contacts 33 are inserted in the female contact accommodation bores 32 of the front and rear jack section contact holders 31, and the contact holders 31 are joined together back to back. Thus, each pair of female contacts 33 are insertedly held in the corresponding female contact accommodation bores 32 of the front and rear jack section contact holders 31 in a state electrically connected to each other by the associated uniting member 331, and the uniting members 331 are accommodated in the recesses 311 formed in central portions of the inner edge surfaces of the front and rear jack section contact holders 31.

Then, the two semi-cylindrical halves 300 of the cylindrical ground terminal 30 are fitted on the outer periphery of the contact holders 31 and closed edge to edge into a cylindrical form with the projections 310 of the contact holders 31 fitted in their engagement holes 302 formed at the center thereof.

Figure 25:
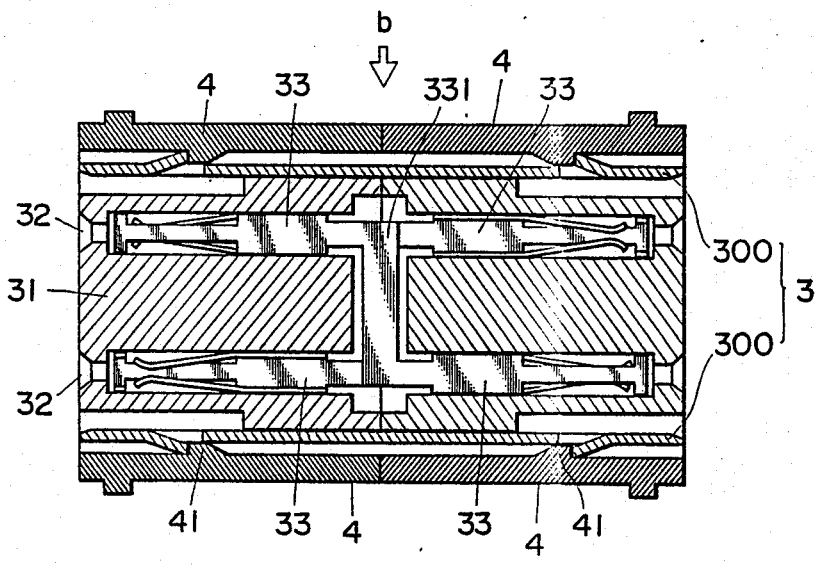
FIG. 25 is an axial sectional view showing an assembled adapter socket.

Subsequently, the cylindrical holders 4 are fitted on the closed semi-cylindrical halves 300 from the front and rear ends thereof. As each cylindrical holder 4 is fitted, the locking protuberances 41 formed on its inner periphery clear and come into engagement with the locking pawls 301 of the semi-cylindrical halves 300. In the above way, an adapter socket body b is assembled as shown in FIG. 25, which comprises the cylindrical ground terminal 30, front and rear contact holders 31 and female contacts 33.

Figure 28:
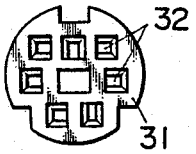
FIGS. 26 to 28 are views showing various jack section female contact arrangement patterns.
Figure 27:
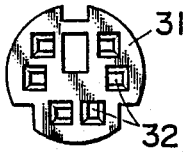
Figure 26:
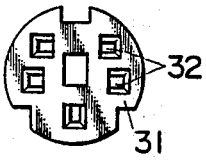
Figure 29:
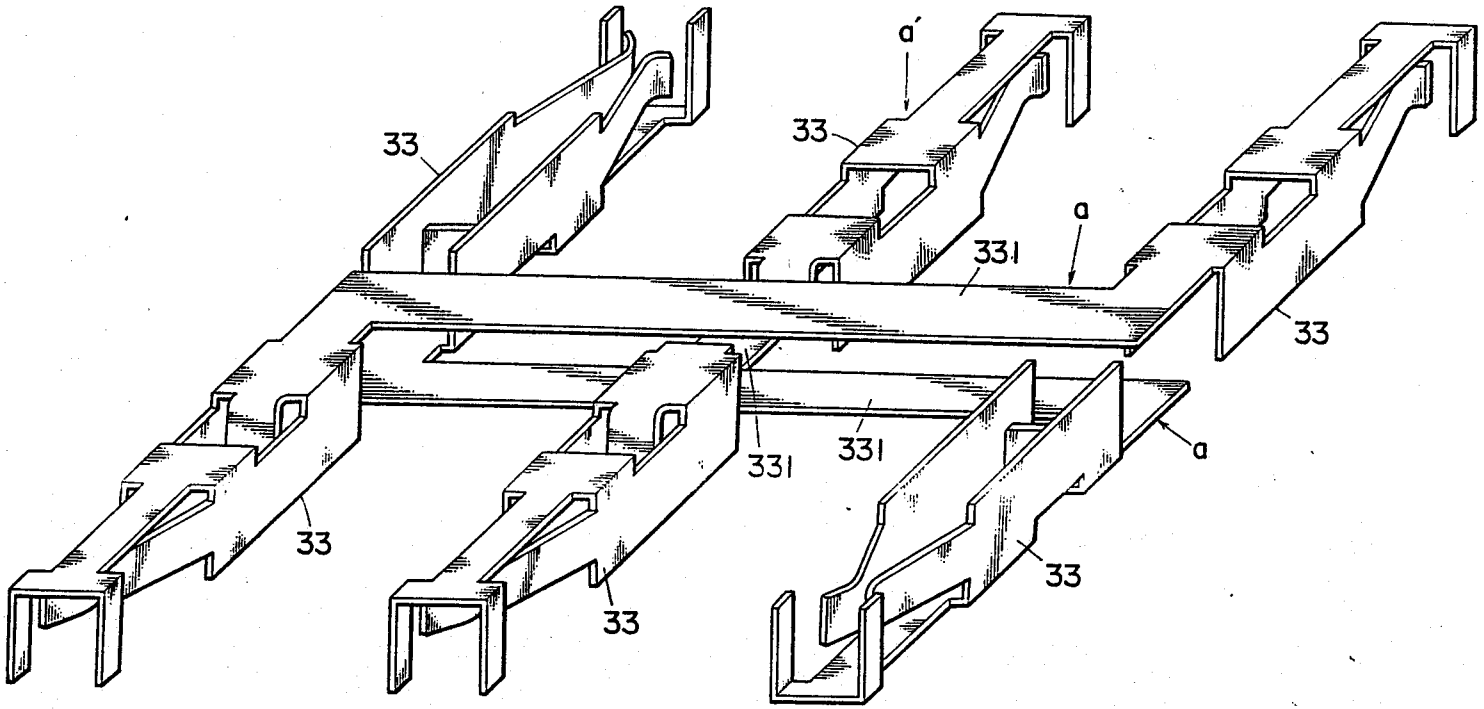
FIG. 29 is a perspective view showing a different female contact union combination.

Consequently, the outer periphery of the adapter socket body b is separately molded or covered with the body 2 made by insert molding with the adapter socket body b as a core to thereby assemble the adapter socket S as a product.

Where the adapter socket S to be assembled is for use with three-contact small-size multicontact plugs P, in which the central female contact accommodation bore 32 noted above is used as well, each of the female contacts 33 united by the uniting member 331 along a straight line as shown in FIGS. 18 and 19 is inserted in that female contact accommodation bore 32.

Where the adapter socket S to be assembled is for use with five- or six-contact small-size multicontact plugs, in which the female contact accommodation bores 32 of each contact holder are arranged in a pattern as shown in FIGS. 26 or 27, a plurality of female contact union combinations noted above, one of which is shown in FIG. 24, may be used in a vertically stacked fashion.

Where the adapter socket S to be assembled is for use with three-contact small-size multicontact plugs P, in which the three female contact accommodation bores 32 of each contact holder are arranged along a line as shown in FIG. 28, a female contact union combination as shown in FIG. 29 is used. This female contact union combination consists of two female contact unions a, one of which is shown in FIG. 16, and a female contact union a' shown in FIGS. 18 and 19, the former female contact union a for the central female contacts 33 and the latter for the opposite side female contacts 33 in the contact arrangement pattern. In this case, a longitudinally intermediate portion of the uniting member 331 of the female contact union a' is bent such that it is located between and spaced apart from the uniting members 331 of the female contact unions a overlapped over each other.

As has been described in the foregoing, with the relay adapter socket for small-size multicontact plugs according to the present invention, which comprises a pair of jacket sections 3 symmetrically provided in front and rear portions of a cylindrical body 2 and each including a cylindrical ground terminal 30 consisting of metal sheets, an insulating contact holder 31 surrounded by the ground terminal 30 and a plurality of female contacts 33 inserted and held in contact accommodation bores 32 of the contact holder 31, the female contacts 33 of each jacket section 3 being connected to corresponding female contacts 33 of the other jack section 3, each pair of corresponding female contacts 33 of the pair jack sections 3 having their stems united to each other by a uniting member 331 made of a metal sheet forming the pair female contacts 33 so that the pair female contacts 33 and uniting member 331 altogether constitute a female contact union a having a crankshaft-like plan view, the individual female contacts 33 of the female contact union a being insertedly held in associated female contact accommodation bores 32 of the respective jack sections 3, with mere insertion of the female contacts 33 into the given female contact accommodation bores 32 of the contact holders 31 of the front and rear jack sections 3, these female contacts can be electrically connected in a crossed fashion without need of any particular wiring operation. Thus, it is possible to facilitate the operation of assembling the jack sections 3.

Further, since a common cylindrical ground terminal 30 is used for the pair jack sections 3 and consists of two semi-cylindrical halves 300 having substantially double the length of the contact holder 31 of each jack section 3, the contact holders 31 of the pair jack sections 3 are abutted end to end, and the semi-cylindrical halves 300 are fitted on the abutted contact holders 31 such that they are closed together edge to edge into a cylindrical form and assembled together into the cylindrical form by ,fitting a cylindrical holder 4 of a synthetic resin and having substantially one half the length of the semicylindrical halves 300 on the closed semi-cylindrical halves 300 from each end thereof, it is possible to assemble the front and rear jack sections 3 into an adapter socket body b as shown in FIG. 25, thus facilitating the operation of assembling the front and rear jack sections 3 into the body 2.

What is claimed is:

1. A relay adapter socket for small-size multi-contact plugs comprising:

a pair of jack sections symmetically provided in front and rear portions of a cylindrical body and each including a cylindrical ground terminal consisting of metal sheets, an insulating contact holder surrounded by said ground terminal and a plurality of female contacts inserted and held in female contact accommodation bores of said contact holder, said female contacts of each said jack section being connected to corresponding female contacts of said other jack section;

wherein each pair of corresponding female contacts of said pair of jack sections have stems united to each other by a uniting, member made of a metal sheet forming said pair of contacts so that said pair of female contacts and uniting member altogether constitute a female contact union having a crankshaft-like plan view, and said individual female contacts of said female contact union are insertedly held in associated female contact accommodation bores of said respective jack sections.

2. The relay adapter socket for small-size multicontact plugs according to claim 1, wherein a common cylindrical metal ground terminal is used for said pair of jack sections and consists of two semi-cylindrical halves having substantially double the length of said contact holder of each said jack section, said contact holders of said pair of jack sections being abutted end to end, said semi-cylindrical halves being fitted on said abutted contact holders such that they are closed together edge to edge into a cylindrical form and assembled together into the cylindrical form by fitting a cylindrical holder of a synthetic resin and having substantially one half the length of said semi-cylindrical halves on said closed semi-cylindrical halves from each end thereof.

* * * * *